US005687799A

United States Patent [19]

Greenfield et al.

[11] Patent Number: 5,687,799

[45] Date of Patent: Nov. 18, 1997

[54] WHEEL ASSEMBLY FOR A COMPACTING MACHINE

[75] Inventors: Gary L. Greenfield, Palos Heights; Harvey A. Knell, Yorkville; David O. Philips, Metamora; James M. Retterer, Naperville, all of Ill.

[73] Assignee: Caterpillar Inc., Peoria, Ill.

[21] Appl. No.: 700,598

[22] Filed: Aug. 12, 1996

[51] Int. Cl.[6] ..... E01D 19/25

[52] U.S. Cl. ..... 172/540; 172/554; 404/124

[58] Field of Search ..... 37/142.5; 172/550, 172/554; 404/121, 124; 405/128; 301/44.1; 305/107

[56] References Cited

U.S. PATENT DOCUMENTS

| | | | |
|---|---|---|---|
| 379,308 | 3/1888 | Elwell . | |
| 517,352 | 3/1894 | Maxwell . | |
| 1,704,986 | 3/1929 | Marcy . | |
| 2,131,324 | 9/1938 | Hull . | |
| 3,071,050 | 1/1963 | Shatto | 172/554 X |
| 3,245,478 | 4/1966 | Thompson | 172/240 |
| 3,318,211 | 5/1967 | Grace | 94/50 |
| 3,340,783 | 9/1967 | Edminster | 404/121 |
| 3,446,123 | 5/1969 | Lathens | 172/554 X |
| 3,823,983 | 7/1974 | Peterson | 404/124 X |
| 5,033,906 | 7/1991 | Jordan | 404/124 |
| 5,217,322 | 6/1993 | Corcoran | 172/554 X |
| 5,330,260 | 7/1994 | Freeman | 305/12 |
| 5,360,288 | 11/1994 | O'Neill et al. | 404/121 X |

OTHER PUBLICATIONS

Hanomag (how to solve waste disposal problems)—Hannover, Germany (no date).

*Primary Examiner*—Terry Lee Melius
*Assistant Examiner*—Robert Pezzuto
*Attorney, Agent, or Firm*—William C. Perry

[57] ABSTRACT

In the operation of a landfill compactor it is a common problem for the wheels to pick up debris, especially wire and cable, and carry it around the wheel as they rotate. When the debris falls from the wheels in the direction toward the frame and the axles, it becomes packed between the frame and the axle hampering machine operation and requiring hours of corrective maintenance. The wheel assembly of the subject invention provides teeth that are positioned across the width of the wheel assembly in a plurality of rows. The outermost row is positioned adjacent the outer periphery of the wheel assembly while the innermost row is spaced from the inner periphery a preselected distance (X).

10 Claims, 1 Drawing Sheet

WHEEL ASSEMBLY FOR A COMPACTING MACHINE

TECHNICAL FIELD

This invention relates to the construction of wheel assemblies and more particularly those wheel assemblies used on landfill compactors.

BACKGROUND ART

In the operation of modern day landfills, it is imperative to obtain maximum compaction of the material deposited in the landfills to utilize their available capacity to its fullest extent. To that end a relatively specialized machine has been developed to break up and compress the refuse and is commonly known as a landfill compactor. The typical landfill compactor has specialized wheels that have a plurality of individual teeth that extend radially from a cylindrical drum. The teeth are separated from one another to localize the pressure, exerted by the weight of the vehicle, on the ends of the respective teeth. In doing so, more pressure is applied to the material underfoot to thereby increase the amount of compactive force applied by the machine.

The configuration of compactor wheels is varied. Most wheel configurations have a plurality of teeth that are positioned in axially spaced rows that are evenly distributed across the width of the cylindrical drum defined by the wheel. The teeth of one axially spaced row are circumferentially offset from the next so as to stagger the circumferential spacing about the drum. In many instances the teeth are substantially truncated and end in a slight taper or point. This type of tooth is generally known as a "sheepsfoot" tooth and is intended primarily for compressing the material underfoot as much as possible as the machine makes several passes over the fill area. While this type of wheel has been known to work very well for its intended purpose, the nature of the environment in which they operate provides very difficult obstacles to the operation of the machine.

One such obstacle that is particularly prevalent, is the tendency for the wheel assembly to catch material on the teeth and entrain it about the adjacent axle assembly as the machine traverses the landfill. Wire, which is very often disposed of in landfills, is a particular problem. Typically the inner row of teeth, particularly on a sheepsfoot wheel, will snag the wire and carry it around the axle. As the movement of the machine continues, the wire will at some point in time become entrained about the axle, trapping all kinds of other debris, which will eventually become packed into all the areas in and around the frame and the axle of the machine. Not only does this packing of material interfere with the proper operation of the machine, in some cases preventing proper axle oscillation, it also creates tremendous wear to the structure of the wheel assemblies. This situation can only be alleviated by removing the machine to a work area, removing the wheel assemblies, cutting the wire and debris away with a torch and manually removing the debris from the axle and frame. This is not only a costly, labor intensive exercise, but the machine is taken out of production while this maintenance is performed. Ultimately, this greatly increases cost and inefficiency of the overall landfill operation.

In order to alleviate this problem, several different cutting devices have been added to the axle and/or wheel assembly to cut the debris as the wheel and/or wheel assembly to cut the debris as the wheel rotates. While this has been known to work in some applications, the additional components increase the overall cost of the machine. Also, the efficiency of the cutting mechanism is highly variable, requiring some periodic, debris-removal maintenance anyway.

The present invention is directed to overcoming one or more of the problems as set forth above.

DISCLOSURE OF THE INVENTION

In one aspect of the present invention a wheel assembly for a compacting machine is disclosed, comprising a frame of a compacting machine, an axle assembly mounted to said frame, a cylindrical drum mountable for rotation on said axle assembly and defining a central axis, said cylindrical drum defining a first end adjacent to said frame, a second end spaced axially a first distance from said first end and an outer cylindrical surface extending between said first end and said second end, and a plurality of teeth disposed about said cylindrical drum, each of said plurality of teeth extending outwardly from said outer cylindrical surface a second distance and being arranged in a number of axially spaced rows including an innermost row and an outermost row, wherein said outermost row is aligned with said second end and said innermost row is spaced apart from said first end a third distance.

In another aspect of the present invention, a wheel assembly for a compacting machine is disclosed, comprising a cylindrical drum adapted for mounting to an axle of a compacting machine and defining a central axis, said cylindrical drum defining a first end, a second end spaced axially a first distance from said first end and an outer cylindrical surface extending between said first end and said second end, a plurality of teeth disposed about said cylindrical drum, each of said plurality of teeth extending outwardly from said outer cylindrical surface a second distance and being arranged in a number of axially spaced rows including an outermost row and an innermost row, wherein said outermost row is aligned with said second end and said innermost row is spaced apart from said first end a third distance, and a flange aligned with said first end, said flange extending outwardly from said outer cylindrical surface a fourth distance.

A wheel assembly as set forth above will greatly reduce the tendency of material and debris, particularly wire and cable, from falling from the wheel toward the frame and axle and becoming lodged therein.

BEST MODE FOR CARRYING OUT THE INVENTION

Figure 1:
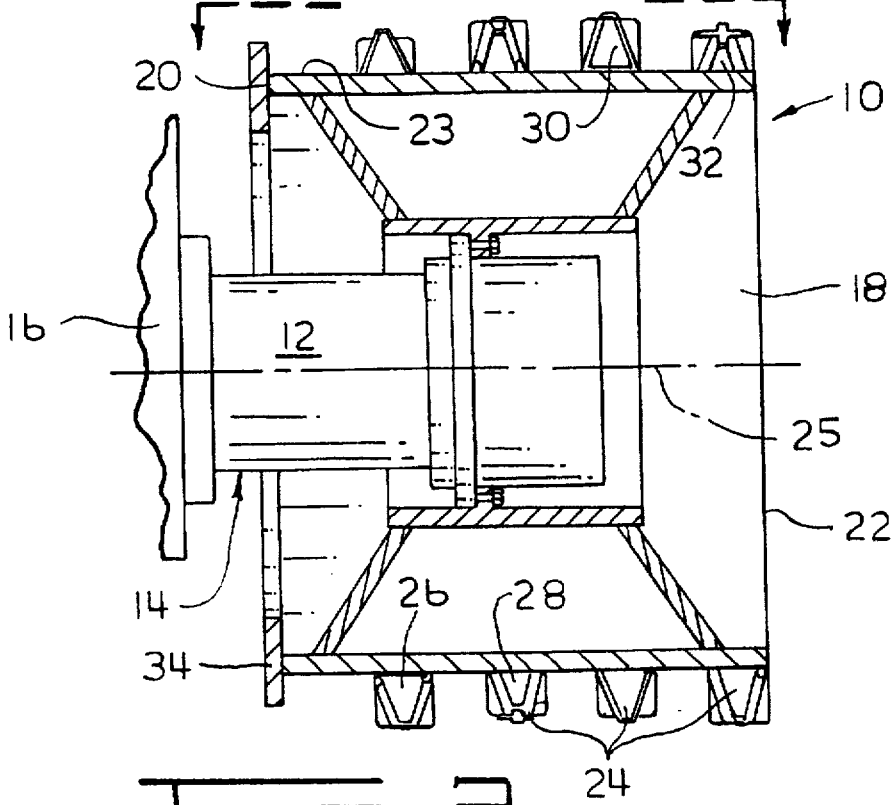
FIG. 1 is a diagrammatic section view of a portion of a compacting machine showing the compacting wheel, the axle and a portion of the machine frame that embodies the principles of the present invention.

Referring to the drawings, it can be seen that a wheel assembly 10 is provided for a compacting machine (not shown). The wheel assembly 10 is mounted on opposing end portions 12 of a pair of axle assemblies 14 (one partially shown) that are positioned at the front and rear of the machine frame 16 in a conventional manner.

Figure 2:
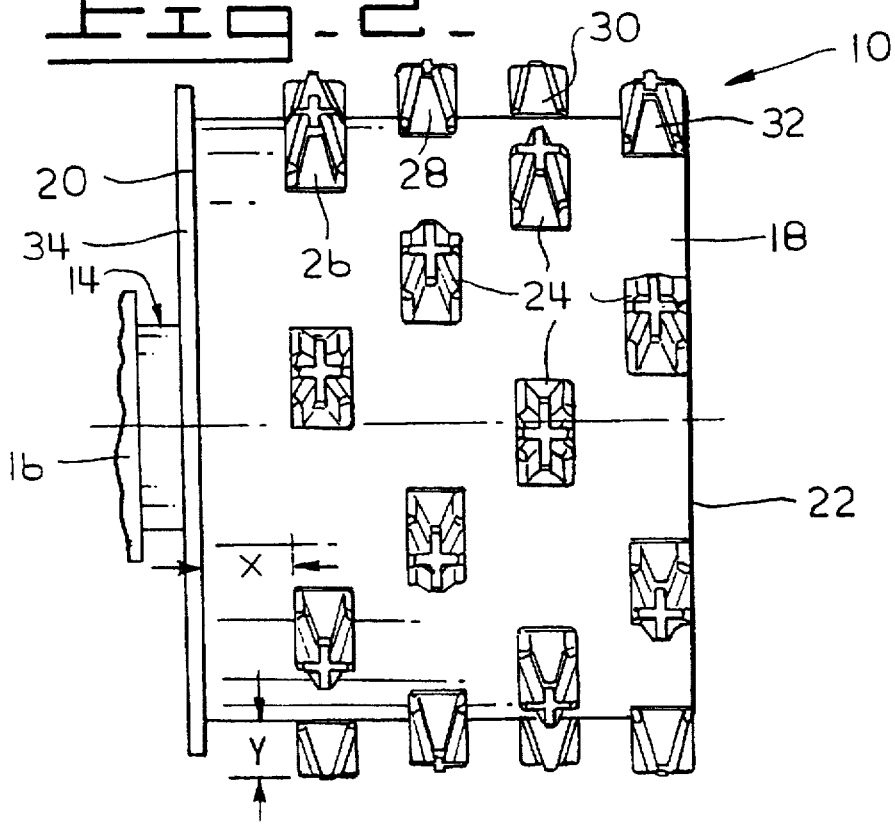
FIG. 2 is a diagrammatic plan view of the wheel of the compacting machine shown in FIG. 1.

Each wheel assembly 10 includes a cylindrical drum member 18 that is mounted for rotation about the axle assembly 14. Each drum member defines a first end 20 that is positioned adjacent the frame 16, a second end 22 that is spaced from the frame by the width of the drum member, and an outer cylindrical surface 23 that extends between the first end 20 and the second end 22. In the specific preferred embodiment shown, first and second ends 20,22 are the outermost peripheral portions of the wheel assembly. A plurality of teeth 24 are positioned circumferentially about the drum member and are equally spaced thereabout. In the illustrated embodiment, wheel assembly 10 defines a central axis 25, and the teeth 24 are shown to be spaced axially along outer surface 23 in four rows 26, 28, 30 and 32. The outermost row of teeth 32 is generally aligned with end 22, while the innermost row of teeth 26 is spaced from end 20 a preselected distance X (FIG. 2). The teeth extend radially outward from the drum member 18 a preselected distance Y (FIG. 2) to establish a uniform tooth height.

Drum member 18 further includes a flange 34 generally aligned with end 20. In the specific preferred embodiment shown, flange 34 is formed in the shape of a continuous ring and is connected to the drum member 18 immediately adjacent to inner periphery 20. In this embodiment, the flange 34 has a uniform configuration that extends radially outward from the drum member a distance that is no greater than approximately 66 percent of the height of each tooth, or preselected distance Y, and no less than approximately 50 percent of the tooth height.

In an alternate design, the flange member 34 may vary in height about the periphery of wheel assembly 10, for example by having a scalloped configuration which defines lobes about the periphery of the wheel. In this configuration, the flange member may extend radially from the drum member 18 a distance that is a maximum of approximately 66 percent of the height of the tooth, or preselected distance Y, and a minimum of 50 percent of the height of the tooth.

In the preferred embodiment, the width of the drum member 18 is approximately 1400 mm (55") and the height of the teeth from the surface of the drum is approximately 160 mm (6.45"). The preselected distance X may be determined as a percentage of the drum width or tooth height. The optimum distance between the innermost row of teeth 26 and the inner periphery 20 of the drum member 18 falls within a range of approximately 100 mm to 190 mm (3.9" to 7.4") which is approximately 7 to 14 percent of the width of the drum member.

The preselected distance X may also be expressed in conjunction with the preselected distance Y, or the height of the teeth. In the preferred embodiment, the distance Y is approximately 160 mm (6.3"). Therefore the spacing between the inner periphery of the drum member 18 and the innermost row of teeth 26 (distance X) may fall within a range of approximately 94 to 108 percent of the height of the teeth.

It is to be understood that while the teeth in the illustrated embodiment are shown to be spaced in four rows 26, 28, 30 and 32, the number of rows of teeth as well as the number of teeth per row may vary without departing from the intent of the present invention.

Industrial Applicability

As previously stated, when a compacting machine is operating in an environment such as a landfill, it will be traversing over terrain that is by nature littered with all sorts of debris. As the teeth of the compacting wheels compress the debris, they often penetrate the various articles and tend to carry them around the wheels as they rotate. As this happens with the wheel assemblies 10 as set forth herein, the debris is not as apt to fall off the wheel assemblies toward the inner periphery 20 due to the spacing of the inner row of teeth 26 from the inner periphery. Further, the flange 34 will further prevent the debris from falling toward the frame of the machine. This is particularly helpful in the deterrence of wire or cable from falling toward the machine frame and becoming entrained about the axle 14.

With wheel assemblies as set forth above, a machine is allowed to operate in such an environment and greatly reduce, if not eliminate, to packing of debris in the area around the axle and the machine frame. In doing so the amount of maintenance previously required to keep this area free of debris, which is a manual, highly labor intensive function, is also reduced or eliminated. This ultimately provides a very substantial reduction in the cost of machine maintenance. At the same time, the machine, through reduced downtime, will be kept in operation thus increasing it operational efficiency and productivity and ultimately, the overall profitability of the landfill operation.

Other aspects, objects and advantages of this invention can be obtained from a study of the drawings, the disclosure and the appended claims.

We claim:

1. A wheel assembly for a compacting machine having a frame and a pair of axle assemblies mounted to the frame, comprising:

a cylindrical drum mountable for rotation on each of an opposing end of at least one of the axle assembly, said cylindrical drums being positioned on opposite sides of the frame, each of said cylindrical drums defining an inner periphery adjacent the frame and an outer periphery;

a plurality of teeth disposed circumferentially about each of the cylindrical drums, said teeth extending outwardly from the cylindrical drums a preselected distance and being disposed in a plurality of axially spaced rows with the outermost of said rows being positioned immediately adjacent the outer periphery of the each cylindrical drum and the innermost of said rows being spaced from the inner periphery a preselected distance.

2. The wheel assembly as set forth in claim 1 wherein an upstanding flange is connected to the inner periphery of each cylindrical drum and extends radially outwardly therefrom a preselected distance.

3. The wheel assembly as set forth in claim 2 wherein the upstanding flange extends radially outwardly from the cylindrical drum a distance that falls within a range of approximately 50 to 66 percent of said preselected distance defined by the teeth.

4. The wheel assembly as set forth in claim 3 wherein the upstanding flange is a continuous ring having a scalloped configuration whose radial extension from the cylindrical drum varies from a maximum distance that is approximately 66 percent of the preselected distance defined by the teeth and a minimum distance of approximately 50 percent of said preselected distance.

5. The wheel assembly as set forth in claim 1 wherein the space between the inner row of teeth and the inner periphery of the cylindrical drum is approximately 7 percent to 14 percent of the overall width of the cylindrical drum.

6. The wheel assembly as set forth in claim 1 wherein the preselected spacing between the inner periphery and the inner row of teeth is approximately 94 to 108 percent of the preselected height of the teeth.

7. A wheel assembly for a compacting machine, comprising:

a cylindrical drum member having inner and outer extremities;

a plurality of teeth disposed circumferentially about the cylindrical drum member in a plurality of axially spaced rows, an outermost rows of said teeth being located immediately adjacent the outer extremity of the cylindrical drum member and an innermost row of said teeth being spaced from the inner extremity a preselected distance; and an upstanding flange member mounted to the cylindrical drum member about the inner extremity thereof.

8. The compactor wheel assembly set forth in claim 7 wherein each of the teeth extend radially from the cylindrical drum member a preselected distance and the flange member extends radially from the cylindrical drum member a distance that is no greater than approximately 66 percent of the preselected distance the teeth extend from the cylindrical drum member.

9. The compactor wheel assembly as set forth in claim 7 wherein five rows of teeth are defined axially across the width of the cylindrical drum member, each row having 7 teeth equally spaced about the circumference of the cylindrical drum.

10. The compactor wheel assembly as set forth in claim 7 wherein four rows of teeth are defined axially across the width of the cylindrical drum member, each row having 7 teeth equally spaced about the circumference of the cylindrical drum.

* * * * *